US005964684A

United States Patent [19]

Sokol

[11] Patent Number: 5,964,684

[45] Date of Patent: Oct. 12, 1999

[54] EXERCISE METHOD AND APPARATUS

[76] Inventor: Steven D. Sokol, 414 Beckham Dr., San Jose, Calif. 95123

[21] Appl. No.: 08/635,106

[22] Filed: Apr. 19, 1996

[51] Int. Cl.[6] ..... A63B 21/068; A63B 21/04

[52] U.S. Cl. ..... 482/96; 482/130; 482/135; 482/137

[58] Field of Search ..... 482/72, 92, 95, 482/96, 100, 101, 130, 135, 137, 139, 93, 131, 138; D21/195

[56] References Cited

U.S. PATENT DOCUMENTS

| | | | |
|---|---|---|---|
| 209,377 | 10/1878 | Britt | 482/72 |
| 339,638 | 4/1886 | Goldie | 482/96 |
| 2,783,045 | 2/1957 | Bosch | 482/96 |
| 3,998,454 | 12/1976 | Jones | 482/139 |
| 4,256,302 | 3/1981 | Keiser et al. | 482/100 |
| 4,272,074 | 6/1981 | Sferle | 482/96 |
| 4,468,025 | 8/1984 | Sferle | 482/96 |
| 4,706,953 | 11/1987 | Graham | 482/96 |
| 4,911,438 | 3/1990 | Van Straaten | 482/130 |
| 5,042,797 | 8/1991 | Graham | 482/96 |
| 5,102,121 | 4/1992 | Solow et al. | 482/137 |
| 5,263,913 | 11/1993 | Boren | 482/95 |
| 5,330,405 | 7/1994 | Habing et al. | 482/96 |
| 5,334,120 | 8/1994 | Rasmussen | 482/135 |
| 5,354,251 | 10/1994 | Sleamaker | 482/96 |

FOREIGN PATENT DOCUMENTS

| | | | |
|---|---|---|---|
| 1674873 | 9/1991 | U.S.S.R. | 482/95 |

OTHER PUBLICATIONS

Pro–Form Bodylift, Owner's Manual, 1994.
WESLO Body Focus, Owner's Manual, 1994.

*Primary Examiner*—Richard J. Apley
*Assistant Examiner*—Victor K. Hwang
*Attorney, Agent, or Firm*—The Kline Law Firm

[57] ABSTRACT

An exercise apparatus has a body supporting carriage that moves relative to a frame in a direction having a vertical component. Levers are movably mounted on the carriage and connected to the frame in such a manner that movement of the levers relative to the carriage is linked to movement of the carriage relative to the frame.

21 Claims, 7 Drawing Sheets

EXERCISE METHOD AND APPARATUS

FIELD OF THE INVENTION

The present invention relates to exercise equipment and more particularly, to an exercise apparatus that provides resistance to various arm, leg, and/or abdominal exercises as a function of a person's body weight.

BACKGROUND OF THE INVENTION

Most exercise equipment is designed with a relatively specific purpose in mind. For example, a substantial amount of exercise equipment is dedicated to strength training exercise. Some such equipment is designed specifically to work and strengthen a particular muscle or muscle group, and other such equipment is designed to work and strengthen a variety of muscles and/or muscles groups either through accessories or adjustments to the equipment, or at a plurality of stations associated with the equipment. Despite the existence of numerous strength training devices, a need remains for a relatively simple apparatus that works all of the major muscle groups at a single station and without requiring complicated accessories or adjustments.

Another type or category of exercise equipment is dedicated to aerobic exercise. Some such equipment requires movement of only the arms or legs, while other such equipment requires contemporaneous movement of both the arms and legs, and still other such equipment offers both in the alternative. As compared to strength training apparatus, aerobic equipment is typically designed to facilitate a substantially longer continuous workout by providing relatively less resistance to the exercise movements. Despite the existence of numerous aerobic exercise devices and numerous strength training devices, a need remains for a relatively simple apparatus that facilitates or incorporates both types of exercise at a single station and without requiring complicated accessories or adjustments.

Yet another type or category of exercise equipment is dedicated to stretching exercise. Most such equipment is designed to stretch a person's legs and/or back muscles by guiding and/or supporting a person's body through a complete range of motion. As compared to aerobic exercise equipment, and even strength training apparatus, stretching devices are typically designed to facilitate slow and deliberate exercise movements. Despite the existence of numerous aerobic exercise devices, a need remains for a relatively simple apparatus that facilitates aerobic exercise and encourages exercise through a full range of motion at a single station and without requiring complicated accessories or adjustments.

SUMMARY OF THE INVENTION

A preferred embodiment of the present invention provides an exercise apparatus having a body supporting carriage mounted on a frame and movable relative to the frame at a desired angle relative to a floor surface on which the frame rests. A foot platform is mounted to a lower end of the frame and is accessible to receive and support the feet of a person lying supine against the carriage. The foot platform provides a brace against which the person may push with his or her legs to drive the carriage upward relative to the frame. The foot platform is movably mounted to the frame and moves between a storage position in which the foot platform lies substantially flat against the frame, and an operable position in which the foot platform extends perpendicular to the direction traveled by the carriage relative to the frame (regardless of the particular angle relative to the floor surface).

Right and left arms or levers are mounted on opposite sides of the carriage and are rotatable relative thereto. Each of the levers is connected to an upper end of the frame by means of a flexible line. In the preferred embodiment, a first flexible line extends from a first end connected to the frame to a second end connected to a pulley or reel associated with the right lever, and a second flexible line extends from a first end connected to the frame to a second end connected to a pulley or reel associated with the left lever. An intermediate portion of each flexible line wraps around a circumferential groove on a respective pulley.

Each of the levers is configured and arranged to receive and move in cooperation with an arm of a person lying supine against the carriage. The axis of rotation of the levers is intended to approximately align with the person's shoulders. Each of the levers includes a first portion and a second portion extending perpendicular to one another and designed to align with the person's upper arm and lower arm (or forearm), respectively. The first portion and second portion of each lever cooperate to define a plane that extends generally perpendicular to the body supporting carriage and generally parallel to the pulleys. Each of the levers further includes a third, L-shaped portion extending from a distal end of a respective second portion, perpendicular to both pulleys and toward one another, and then parallel to a respective first portion, to provide a handgrip.

The levers provide force receiving members against which a person may push with his or her arms to drive the carriage upward relative to the frame and/or to discourage downward movement of the carriage relative to the frame. In particular, application of torque against the pulleys in a first direction is subject to gravitational force acting on the mass of the carriage and person supported thereby. Sufficient torque applied in this first direction causes the pulleys to rotate in the first direction and the flexible lines to wind about the pulleys, thereby drawing the carriage upward relative to the frame. Release of this torque allows the pulleys to rotate in a second, opposite direction and the flexible lines to unwind from the pulleys, thereby allowing the carriage (under the influence of gravity) to return downward relative to the frame. The carriage may be maintained in equilibrium at any point relative to the frame by applying a torque against the pulleys that just offsets the gravitational force acting on the carriage and the person.

The amount of force required to drive the carriage upward is a function of the person's body weight, as well as the angle of inclination at which the carriage moves upward. The necessary force may be applied through the person's arms only, or the person' legs only, or both, with the percentage contribution of each being infinitely variable. In this regard, the present invention provides a significant advantage by allowing a person's arms and legs to work against a common resistance force. For example, if either the arms or the legs fatigue relatively faster, the person's body is allowed to compensate naturally, and no adjustments to the equipment are required. Moreover, if a particular limb is relatively weaker or is injured during exercise, the other limbs are immediately available to compensate and redistribute the load.

Another advantage of the present invention is that both strength training and aerobic exercises may be performed at a single station and without complicated accessories or adjustments. For example, a simple adjustment of the angle of inclination traversed by the carriage effectively changes the resistance level, thereby allowing transformation of the device from a strength training apparatus to an aerobic exercise apparatus, and vice versa. Another way of making this transformation between strength training and aerobic exercise is simply to switch between exercises using only arms or legs to exercises using both. Abdominal and lower back muscles may also be exercised in relative isolation by performing leg lifts and/or crunches while the carriage is in a lowermost, rest position and/or while using the arms to offset the gravitational force and maintain the carriage in an upward position. Thus, the present invention effectively and directly exercises all of the major muscle groups of the human body.

The present invention also facilitates stretching exercises to the extent that it allows a full range of motion for the arms and legs. The carriage encourages proper posture and effectively eliminates stress on the lower back. Furthermore, the various available exercises are weight bearing yet impart little or no impact to the joints. In addition to facilitating effective and diverse exercise, the present invention is cost effective to manufacture and simple to use. These advantages and others will become apparent to those skilled in the art upon a more detailed description of the preferred embodiment.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

Figure 1:
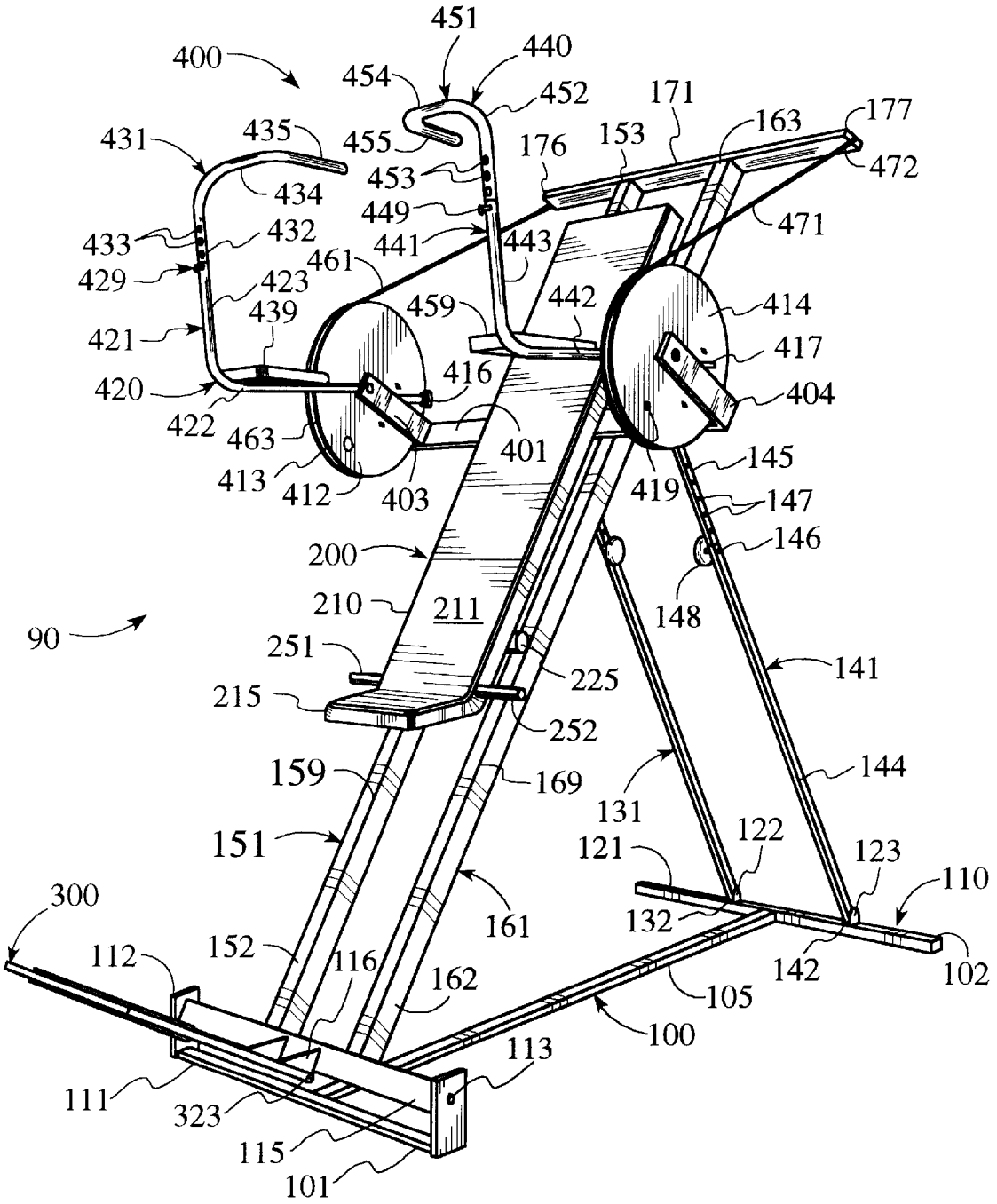
FIG. 1 is a perspective view of a first embodiment of an exercise apparatus constructed according to the principles of the present invention.
Figure 2:
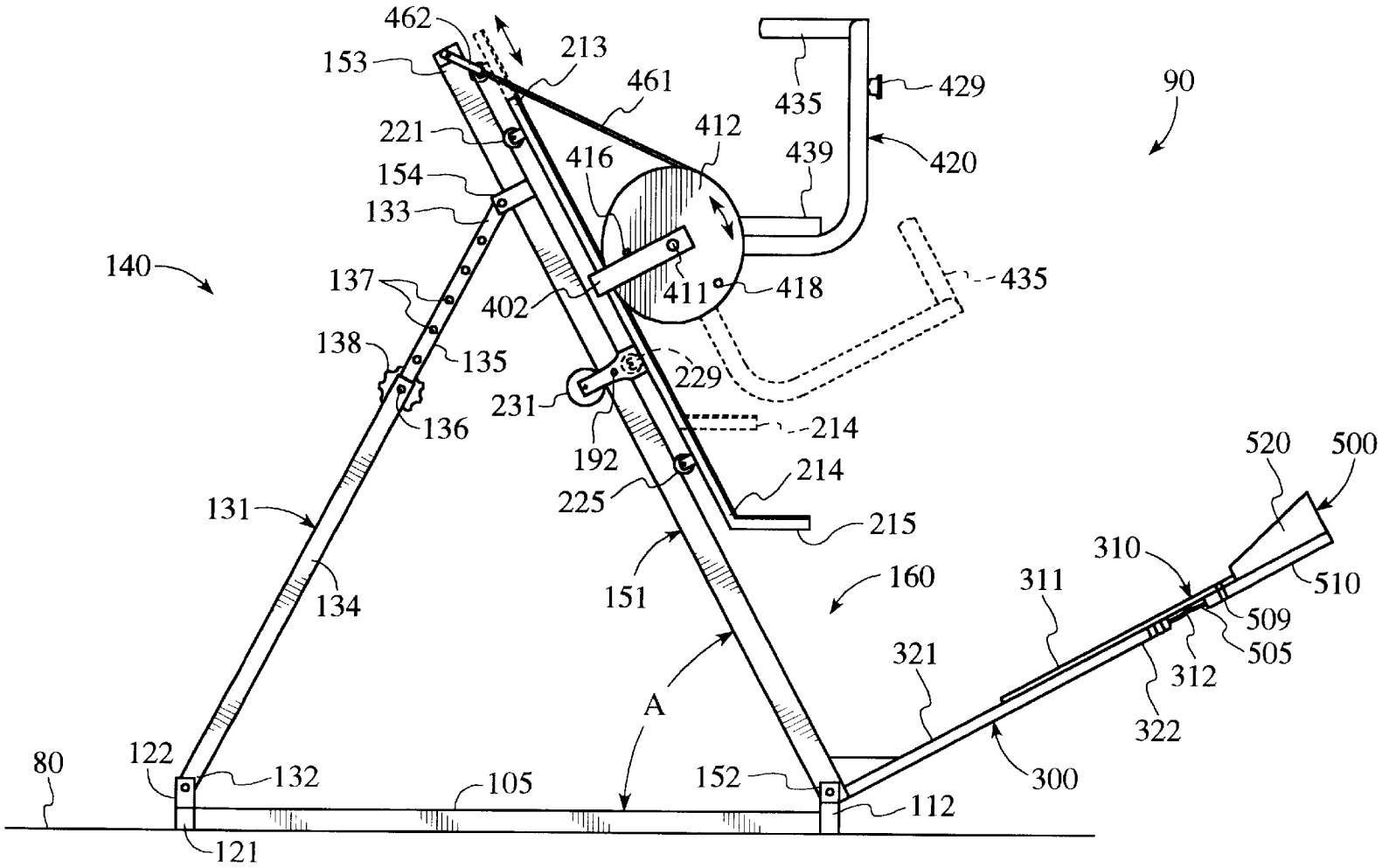
FIG. 2 is a side elevation view of the exercise apparatus shown in FIG. 1.
Figure 3:
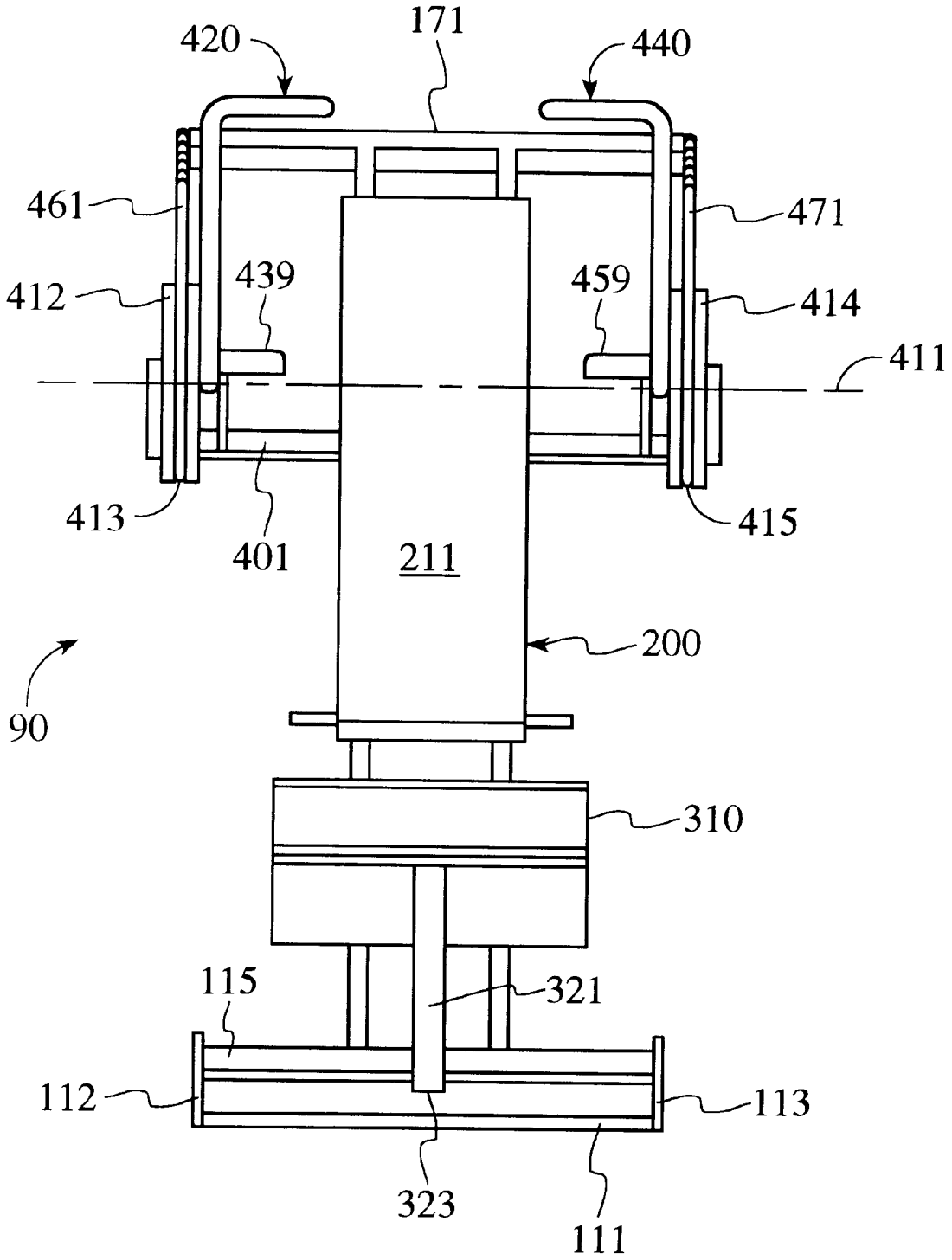
FIG. 3 is a front view of the exercise apparatus shown in FIG. 1.

A first embodiment of an exercise apparatus constructed according to the principles of the present invention is designated as 90 in FIGS. 1–3. The apparatus 90 generally includes a frame 100, a body supporting means 200 movably connected to the frame 100, for supporting a person's body, a leg exercise means 300 connected to the frame 100, for facilitating leg exercises, and an arm exercise means 400 connected to the body supporting means 200, for facilitating arm exercises.

The frame 100 includes a floor engaging portion or base 110 which extends between a front end 101 and a rear end 102. The base 110 includes a front transverse bar 111 and a rear transverse bar 121 which extend parallel to one another. A central longitudinal bar 105 is interconnected between the front and rear bars 111 and 121 and cooperates therewith to define an I-shaped base 110. Right and left trunnions 122 and 123 are secured to the rear bar 121 and extend generally perpendicular from the bar 121 and upward away from the floor surface 80. Right and left trunnions 112 and 113 are secured to the front bar 111 and extend generally perpendicular from the bar 111 and upward away from the floor surface 80.

The rearward trunnions 122 and 123 provide a means for pivotally connecting right and left braces 131 and 141 to the rear bar 121. In particular, a right brace 131 extends from a lower end 132 to an upper end 133, and the lower end 132 thereof is connected by a nut and bolt combination to the trunnion 122. Similarly, a left brace 141 extends from a lower end 142 to an upper end (not shown), and the lower end 142 thereof is connected by a nut and bolt combination to the trunnion 123.

The right brace 131 includes a first segment 134 and a second segment 135 which telescope relative to one another. At least one hole 136 is formed through the first segment 134, and several holes 137 are formed through the second segment 135 to receive a pin or other fastener 138 when the hole 136 is aligned with any of the holes 137. When inserted through an aligned pair of holes 136 and 137, the pin 138 prevents relative movement of the segments 134 and 135, thereby defining a fixed length for the right brace 131. Those skilled in the art will recognize that a plurality of holes need be provided in only the second segment 135 in order to facilitate this telescoping adjustment feature, but that the invention is not limited in this regard.

The left brace 141 similarly includes telescoping first and second segments 144 and 145 and holes 146 and 147 formed through the segments 144 and 145, respectively. A pin 148 similarly inserts through any aligned pair of holes 146 and 147 to define a fixed length for the left brace 141.

An elongate support 115 extends between the trunnions 112 and 113 and is rotatably mounted relative thereto by means of pins extending from opposite ends of the support 115 and through holes in the trunnions 112 and 113. A right rail 151 has a lower end 152 which is secured to the rotating support 115. The right rail 151 is an elongate piece of steel tube having a square cross-section. The right rail 151 extends from the lower end 152 to an upper end 153. A trunnion 154 is connected to an intermediate portion of the right rail 151, relatively nearer the upper end 153. The trunnion 154 extends rearward and downward from the rail 151, generally perpendicular thereto. The upper end 133 of the right brace 131 is connected to the trunnion 154 by means of a nut and bolt combination, hereby pivotally connecting the right brace 131 to the right rail 151. The right rail 151, the right brace 131, and the base 110 cooperate to form an acute triangle, and the angle A of at least twenty degrees (shown in FIG. 2) between the right rail 151 and the base 110 is a function of the length of the right brace 131. In the embodiment 90, this angle A may be adjusted in five degree increments between a lower extreme of thirty degrees and an upper extreme of sixty degrees.

A left rail 161 similarly cooperates with the left brace 141 and the base 110 to form an acute triangle. The angle between the left rail 161 and the base 110 (which coincides with the angle A) is similarly a function of the length of the left brace 141. In particular, a lower end 162 of the left rail 161 is secured to the rotating support 115. The left rail 161 is also an elongate piece of steel tube having a square cross-section. The left rail 161 extends from the lower end 162 to an upper end 163, and a trunnion (not shown) extends rearward and downward from an intermediate portion of the right rail 161, relatively nearer the upper end 163. The upper end of the left brace 141 is connected to the trunnion by means of a nut and bolt combination, thereby pivotally connecting the left brace 141 to the left rail 161.

The braces 131 and 141 extend substantially parallel to one another and cooperate to provide a brace or supporting means 140 for supporting the rails 151 and 161 in an inclined and adjustable orientation relative to the floor surface 80. The rails 151 and 161 extend substantially parallel to one another and cooperate to provide a rail or guiding means 160 for guiding movement of the carriage 200 relative to the frame 100. The pivotal connections between the supporting means 140 and the guiding means 160 and the frame 100 allow the apparatus 90 to fold down or collapse for storage and/or transportation.

In the embodiment 90 shown in FIGS. 1–3, the body supporting means 200 includes a carriage or platform 210 having a generally upwardly facing, body supporting surface 211 and an opposite, generally downwardly facing surface, which faces toward the rails 151 and 161. The body supporting surface 211 is substantially flat and extends from an upper end 213 to a lower end 214. Fixed handles 251 and 252 extend from opposite sides of the carriage 210, proximate the lower end 214. Also, just.beyond the lower end 214 of the body supporting surface 211, a lip or partial seat 215 extends at an angle of approximately 120 degrees relative thereto.

As shown in FIG. 2, two rollers 221 are secured to the opposite or back surface of the carriage 210, proximate the upper end 213 thereof, and are rotatable relative thereto. These "upper" rollers 221 are disposed between the carriage 210 and the rails 151 and 161 and roll along generally upwardly facing surfaces 159 and 169, respectively. Two more rollers 225 are secured to the back surface of the carriage 210, proximate the lower end 214 thereof, and are rotatable relative thereto. These "lower" rollers 225 are similarly disposed between the carriage 210 and the rails 151 and 161 and roll along the same generally upwardly facing surfaces 159 and 169, respectively. Similarly, two "intermediate" rollers 229 are rollably mounted relative to the back surface of the carriage 210 and rollable along the rails 151 and 161.

Two additional rollers 231 are secured to the back surface of the carriage 210, relative to the same brackets as those associated with the intermediate rollers 229, and are rotatable relative thereto. These rollers 231 are disposed on the opposite sides of the rails 151 and 161, respectively, and roll along generally downwardly facing surfaces thereon. These "underside" rollers 231 maintain the carriage 200 in close proximity to the rails 151 and 161 and cooperate with the rollers 221, 225, and 229 to provide a connecting means for movably connecting the carriage 200 to the frame 100. A pin 192 may be inserted through holes in the brackets for at least one of the rollers 231 and in at least one of the rails 151 and 161 to lock the carriage 210 in place relative to the rails 151 and 161 if and when desired.

Although the carriage 200 is movably connected to the frame 100 by means of rollers in the embodiment 90, those skilled in the art will recognize that the carriage may be movably connected to the frame in other ways without departing from the scope of the present invention. For example, a four bar linkage could be substituted with the carriage functioning as the so-called coupler.

The leg exercising means 300 includes a foot support or platform 310 having a generally upwardly facing, foot supporting surface 311 and an opposite, generally downwardly facing surface 312, which faces generally toward the floor 80. A cantilevered bar 321 extends from a first end 322 connected to the "underside" 312 of the foot support 310, to a second end 323 connected to the frame 100. In particular, the second end 323 is connected by means of a nut and bolt combination to a trunnion 116 mounted on the rotating support 115. As a result, the foot support 310 is pivotally connected to the rotating support 115 and extends in cantilever fashion from this point of connection. In an operative position, the bar 321 is rotated away from the rails 151 and 161 until the second end 323 of the bar 321 engages the rotating support 115 directly beneath the trunnion 116. At this extreme position, the bar 321 and the foot platform 310 extend substantially perpendicular to the rails 151 and 161, regardless of the orientation of the rails 151 and 161 relative to the frame 100 and/or the floor surface 80. For storage and/or transportation purposes, the bar 321 and the foot platform 310 are free to rotate toward the rails 151 and 161 to an orientation substantially parallel and adjacent thereto.

Figure 4:
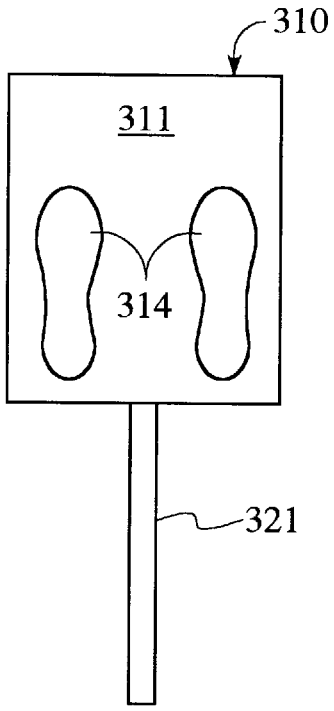
FIG. 4 is a plan view of a foot support forming a part of the exercise apparatus shown in FIG. 1.

The foot support 310 is configured and arranged to support the feet of a person lying supine against the carriage 210. As shown in FIG. 4, guides or outlines 319 are provided on the upwardly facing surface 311 to indicate desirable foot positions. So long as the carriage 210 is free to roll along the rails 151 and 161, a person can position his or her feet approximately as indicated by the guides 319, and perform "squats" and/or "calf raises" to drive the carriage 210 up and down the rails 151 and 161 and thereby exercise the leg muscles. By altering the orientation and/or position of the feet (which may be suggested by additional guides on the upwardly facing surface 311) on the foot support 310, a person can focus the exercises on inner or outer leg muscles. Also, the foot support 310 cooperates with the carriage 210 to encourage proper posture and weight distribution during such exercises.

The arm exercising means 400 includes right and left arms or levers 420 and 440 rotatably connected to the carriage 200. In particular, a U-shaped bar 401 is secured to the back side of the carriage 200 in such a manner that first end segment 402 extends forward and to one side (the right) of the body supporting surface 211, and a second end segment 404 extends forward and to an opposite side (the left) of the surface 211. A first intermediate segment 403 is secured to the U-shaped bar 401, proximate the first end segment 402 and extending generally parallel thereto. A reel or pulley 412 is rotatably secured between the intermediate segment 403 and the end segment 402 by means of a nut and bolt combination. Similarly, a second intermediate segment (not shown) is secured to the U-shaped bar 401, proximate the second end segment 404 and extending generally parallel thereto, and a reel or pulley 414 is rotatably secured between the intermediate segment and the end segment 404 by means of a nut and bolt combination.

The first or right arm 420 is secured to the right pulley 412 and rotates together therewith or not at all. The right arm 420 includes a first, L-shaped member 421 having a radial segment 422 and a tangential segment 423. The radial segment 422 is secured to the pulley 412 and extends radially away from the axis of rotation (designated as 411 in FIGS. 2 and 3) and beyond the circumference thereof. The tangential segment 423 is integrally connected to a distal end of the radial segment 422 and extends generally perpendicular thereto, and thus, tangential to the pulley 412.

The right arm 420 further includes a second member 431 having a first segment 432 that telescopes into and out of the tangential segment 423 on the first member 420. A pin 429 inserts through a hole in the tangential segment 423 and any of several holes 433 in the first segment 432 to adjustably secure the two telescoping segments 423 and 432 together. The second member 431 further includes a second segment or axial segment 434 integrally connected to a distal end of the first segment 433 and extending parallel to the axis 411, and perpendicular to a plane defined by the first, L-shaped member 421. A third segment or handle 435 is integrally connected to an opposite end of the second segment 434 and extends in the same general direction as the radial segment 422 on the first member 421.

A padded support 439 is mounted on the radial segment 422 and defines a plane generally perpendicular to the tangential segment 423. The padded support 439 provides a brace against which a person may press with the rear of his or her right, upper arm. The tangential segment 423 and the first segment 432 cooperate to parallel the person's right, lower arm or right forearm, and to define an effective length commensurate therewith. The third segment or handle 435 provides a grip for the person's right hand.

Similarly, the second or left arm 440 is secured to the left pulley 414 and rotates together therewith or not at all. The left arm 440 includes a first, L-shaped member 441 having a radial segment 442 and a tangential segment 443. The radial segment 442 is secured to the pulley 414 and extends radially away from the axis of rotation 411 and beyond the circumference thereof. The tangential segment 443 is integrally connected to a distal end of the radial segment 442 and extends generally perpendicular thereto, and thus, tangential to the pulley 414.

The left arm 440 further includes a second member 451 having a first segment 452 that telescopes into and out of the tangential segment 443 on the first member 441. A pin 449 inserts through a hole in the tangential segment 443 and any of several holes 453 in the first segment 452 to adjustably secure the two telescoping segments 443 and 452 together. The second member 451 further includes a second segment or axial segment 454 integrally connected to a distal end of the first segment 452 and extending parallel to the axis 411, and perpendicular to a plane defined by the first, L-shaped member 441. A third segment or handle 455 is integrally connected to an opposite end of the second segment 454 and extends in the same general direction as the radial segment 442 on the first member 441.

A padded support 459 is mounted on the radial segment 442 and defines a plane generally perpendicular to the tangential segment 443. The padded support 459 provides a brace against which a person may press with the rear of his or her left, upper arm. The tangential segment 443 and the first segment 452 cooperate to parallel the person's left, lower arm or forearm, and to define an effective length commensurate therewith. The third segment or handle 455 provides a grip for the person's left hand.

An upper transverse bar 171 is connected to the upper ends 153 and 163 of the rails 151 and 161, respectively. The bar 171 extends from a right distal end 176 to a left distal end 177 and perpendicular to the rails 151 and 161. A first flexible line 461 has a first end 462 connected to the right distal end 176 by means of a loop in the line and a catch on the bar 171. The right pulley 412 has a circumferential groove 413 which is suitable for accommodating at least one wind of the flexible line 461. The flexible line 461 extends from the bar 171 and winds partially about the groove 413, terminating in a second looped end 463 which is connected to the pulley 412 by means of a pin 418 inserted through the looped end 463 and the pulley 412, just radially inward from the groove 413.

Similarly, a second flexible line 471 has a first looped end 472 connected to the left distal end 177 of the transverse bar 171 by means of another catch on the bar 171. The left pulley 414 similarly has a circumferential groove 415 which is suitable for accommodating at least one wind of the flexible line 471. The flexible line 471 extends from the bar 171 and winds partially about the groove 415, terminating in a second looped end (not shown) which is connected to the pulley 414 by means of a pin 419 inserted through the looped end and the pulley 414, just radially inward from the groove 415. The interconnection of the flexible lines 461 and 471 between the respective pulleys 412 and 414 and the frame 100 may be said to link rotation of the arms 420 and 440 relative to the carriage 210 to linear movement of the carriage 210 relative to the frame 100. This same interconnection also may be said to convert torque applied against the arms 420 and 440 into force applied against gravity acting upon the mass of the carriage 210 and the user. For example, movement of the arms 420 and 440 from the position shown in solid lines in FIG. 2 to the position shown in phantom lines in FIG. 2 causes upward travel of the carriage 210 (from the position shown in solid lines to the position shown in phantom lines).

As the carriage 210 travels from an uppermost position to a lowermost position, a certain length of flexible cord 461 and 471 unwinds from a respective pulley 412 and 414, and this "certain length" equals the distance between the uppermost position and the lowermost position. The uppermost position is dictated by the length of a user's legs; the lowermost position is dictated by motion limiting stops 416 and 417 inserted through any of several holes through the pulleys 412 and 414, respectively. The stop 416 interferes with the bars 401 and 403 between which the pulley 412 is rotatably mounted; and the stop 417 interferes with the bars 401 and 404 between which the pulley 414 is rotatably mounted. The selected location of the stops 416 and 417 is a function of a user's range of motion and the size of the pulleys 412 and 414, as measured by the distance around the respective grooves 413 and 415. For a typical user, the stops 416 and 417 are positioned so that the arms 420 and 440 can rotate up to two hundred and twenty degrees, from a generally upwardly extending position, in which the radial segments 422 and 442 are substantially parallel to the rails 151 and 161, to a generally downwardly extending position, in which the radial segments 422 and 442 are rotated behind the rails to define an angle of approximately forty degrees therebetween. The stops 416 and 417 are intended to encourage proper exercise technique and minimize the possibility of injury.

Those skilled in the art will recognize that upward travel of the carriage 210 is subject to gravitational force acting on the carriage 210 and the portion of a person's weight supported on the carriage 210; and that this resistance to upward movement of the carriage 210 may be adjusted simply by adjusting the angle of the rails 151 and 161 relative to the floor surface 80. Those skilled in the art will also recognize that the effect of the gravitational force for any given angle of inclination may be varied within each exercise iteration or stroke (between the lowermost position of the carriage 210 and the uppermost position) by providing the pulleys with grooves that are not centered relative to the axis of rotation. In other words, the grooves can border the perimeters of cams specifically designed to match a particular muscular strength curve.

Figure 5:
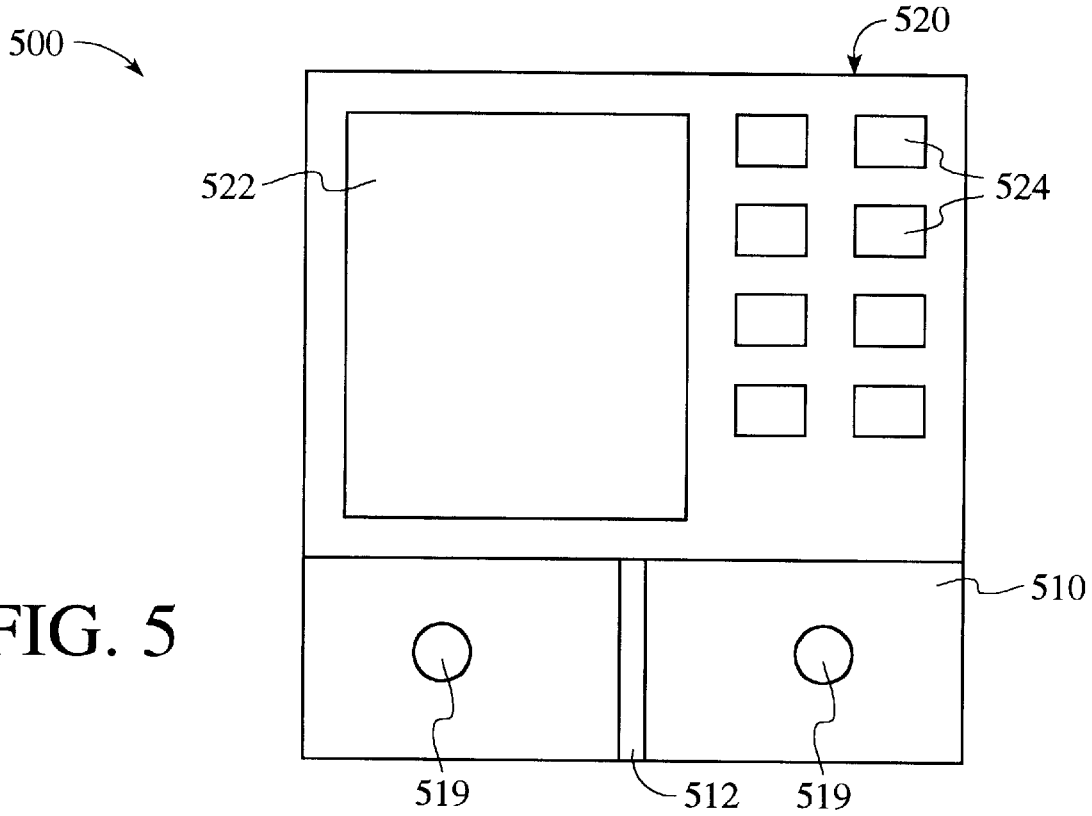
FIG. 5 is a plan view of the electronic display monitor which is mounted on the exercise apparatus shown in FIG. 2.

As shown in FIG. 2, an electronics component 500 may be mounted on the foot platform 310. As shown in FIG. 5, the electronic display monitor 500 includes a base plate 510 and a housing 520 supported thereon. A protruding portion of the base plate 510 is secured to the underside of the foot platform 310 by means of bolts 509 secured within holes 519 formed through the base plate 510. A wire or cable 505 extends from the housing 520, through a groove or channel 512 in the base plate, and into an opening in the end of the cantilevered bar 321. The cable 505 is threaded through the bar 321 and into one of the rails 151 and 161 to a sensor (not shown). By means known in the art, the sensor cooperates with a magnet or other object (also not shown) on the carriage 210 to measure exercise data, such as speed and frequency of exercise movement. This exercise data is transmitted through the cable 505 to the electronics within the housing 520. By pressing different buttons 524 on the housing 520 a person can set exercise parameters to be compared to the actual data and view the actual comparison on the display 522.

Figure 6:
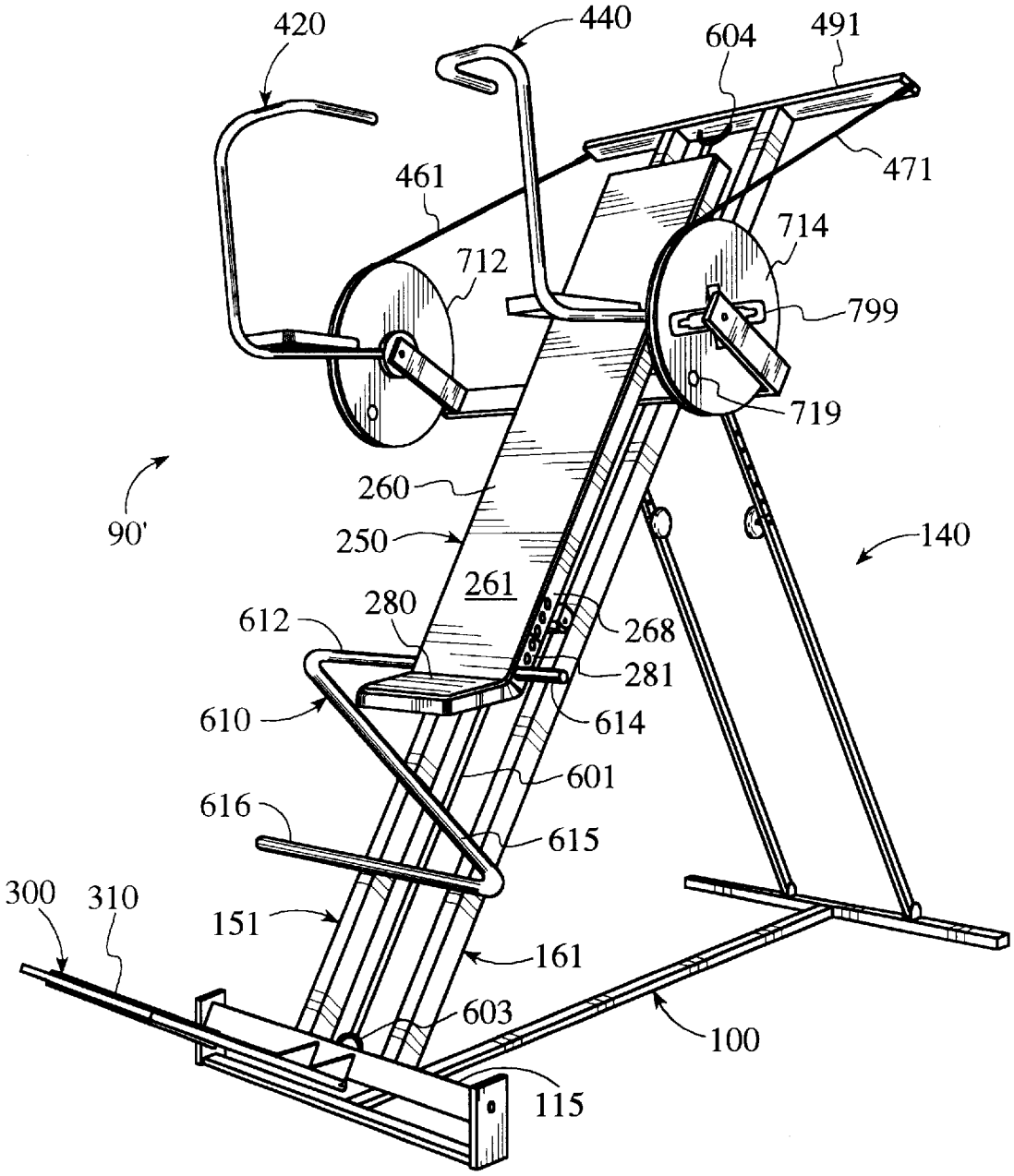
FIG. 6 is a perspective view of a second embodiment of an exercise apparatus constructed according to the principles of the present invention.

Additional features of the present invention are shown on a second embodiment of an exercise apparatus constructed according to the principles of the present invention, which is designated as 90' in FIG. 6. Some of the features of the first embodiment 90 are excluded from the depiction of the second embodiment 90' to facilitate illustration of the additional features. Like the first embodiment 90, the apparatus 90' includes a carriage 250 rollably mounted on a frame 100; a foot platform 310 rotatably mounted on a lower end of the frame 100; arms 420 and 440 rotatably mounted on the carriage 250; and cables 461 and 471 interconnected between respective arms 420 and 440 and the frame 100.

The carriage 250 includes a main body support 260 having a supporting surface 261 similar to that (211) on the first embodiment 90. A lip or partial seat 280 is connected to the supporting surface 261 proximate its lower end. Brackets 281 extend from opposite sides of the seat 280 and overlie supports 268 disposed behind the supporting surface 261. Holes through the brackets 281 align with holes through the supports 268 to receive rods and thereby selectively secure the seat 280 at any one of several positions along the supporting surface 261. In this manner, the apparatus 90' may be adjusted for persons having different leg lengths.

The second embodiment 90' further includes a substantially Z-shaped bar 610 which is rigidly secured to the seat 280. The bar 610 provides right and left handles 612 and 614 which may be grasped by a person lying supine against the carriage 210 to discourage slippage relative thereto while performing squats. The bar 610 also provides a lateral foot support 616 on which a person may rest his or her feet while performing exercises that do not require use of the legs. An intermediate member 615 extends between a right end of the right handle 612 and a left end of the foot support 616.

The second embodiment 90' further includes a biasing means for selectively biasing the carriage 250 toward either the lowermost position or the uppermost position along the rails 151 and 161. In particular, an elastic cord 601 is available to be selectively secured between the carriage 250 and either the rotating support 115 or the upper transverse bar 491. A clip or hook is secured to each end of the elastic cord 601, and one of these hooks interengages a catch or eyelet on the transverse bar 491 extending behind back side of the carriage 210. The other hook may be connected to an eyelet 603 on the rotating support 115, proximate the lower ends of the rails 151 and 161, to cooperate with the gravitational force acting on the carriage 250 and thereby add resistance to upward movement of the carriage 250, as shown in FIG. 6. Alternatively, the other hook may be connected to an eyelet 604 on the upper transverse bar 491, proximate the upper ends of the rails 151 and 161, to act against the gravitational force on the carriage 250 and thereby reduce resistance to upward movement of the carriage 250.

Figure 8:
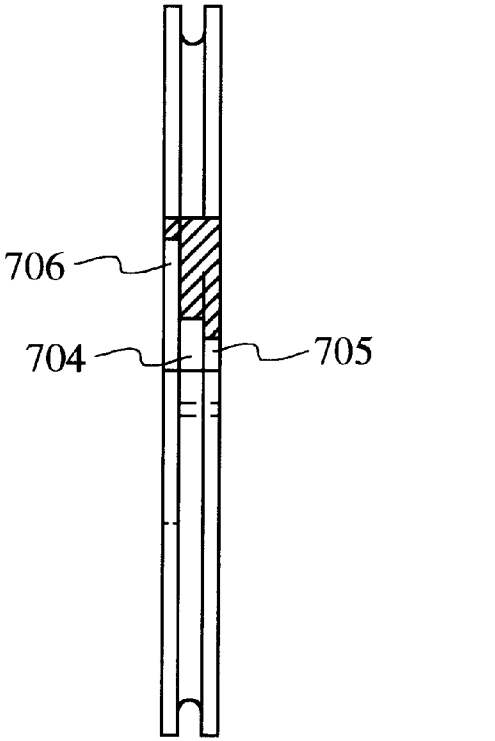
FIG. 8 is a side view of the pulley shown in FIG. 7.
Figure 7:
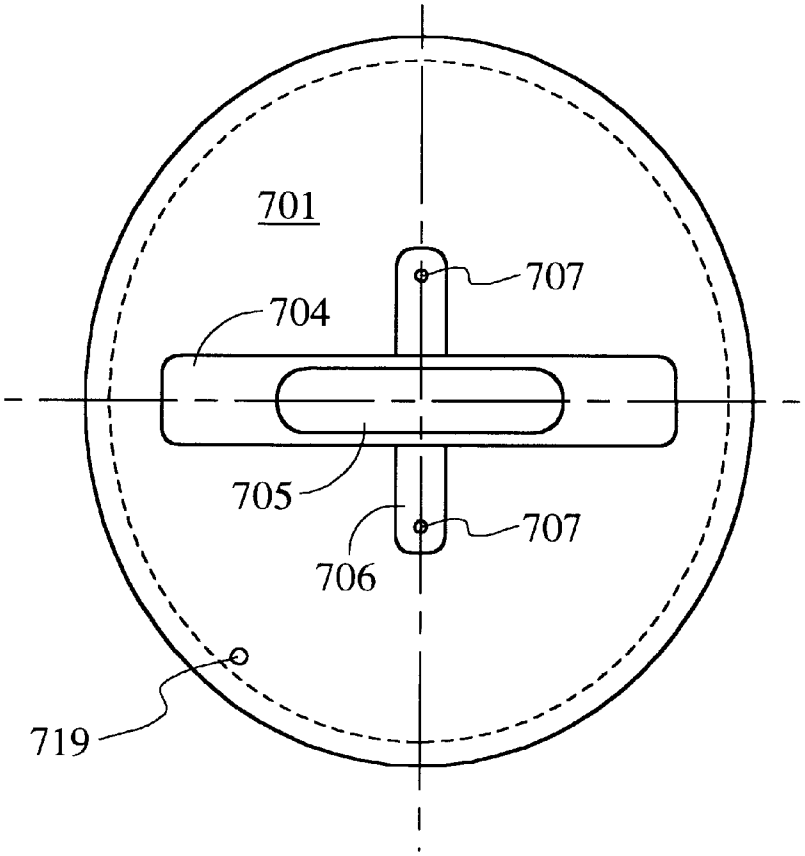
FIG. 7 is a front view of one of the pulleys which s connected to the exercise apparatus shown in FIG. 6.
Figure 9:
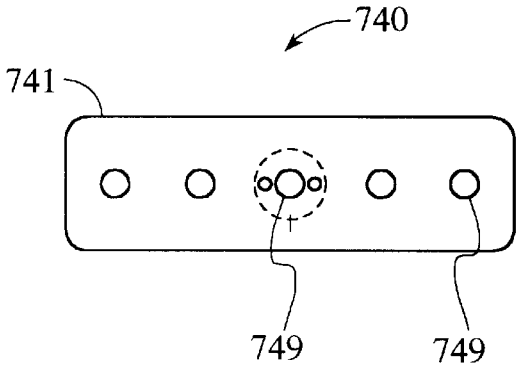
FIG. 9 is a front view of a mounting bar on which is mounted the pulley of FIG. 7.
Figure 10:
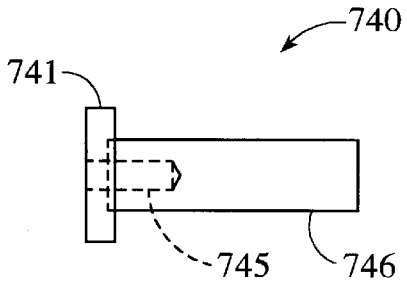
FIG. 10 is a side view of the sliding bar shown in FIG. 9.

The second embodiment 90' also provides a means for varying the relationship between rotation of the arms 420 and 440 and travel of the carriage 250. In particular, each of the arms 420 and 440 is connected to a respective pulley 712 and 714 having an adjustable axis of rotation. The pulley 714, which is representative of the pulley 712, is shown in FIGS. 7–8. The pulley 714 is generally disc-shaped and includes an outwardly facing surface 701. A generally rectangular depression 704 is formed in the surface 701 to slideably receive a mounting bar 740 which is shown in FIGS. 9–10. A slot 705 is nested within the depression 704 and extends through the pulley 714. The slot 705 is elongate and has rounded ends. Pin 719 is equivalent t0 pin 419, as illustrated, for example, in FIG. 1 and as described above.

The mounting bar 740 includes a generally rectangular bar 741 sized and configured to slide within the depression 704 and lie beneath the surface 701. A pin 745 connects the bar 741 to a shaft 746 which extends perpendicularly away from one side of the bar 741. The shaft 746 extends through the slot 705 and mates with a collar on the arm 440. A plurality of holes 749 are formed through the bar 741 and spaced along the longitudinal axis thereof.

Figure 11:
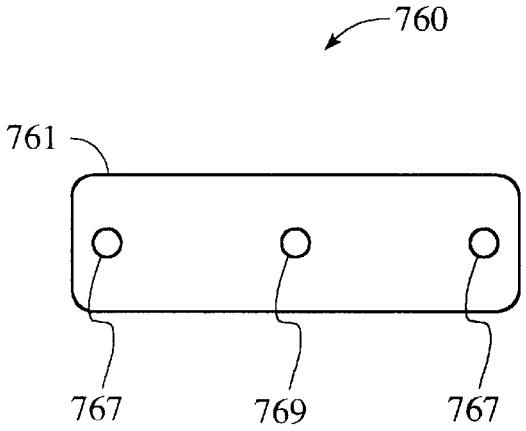
FIG. 11 is a front view of a cover bar which is connected to the pulley of FIG. 7.
Figure 12:
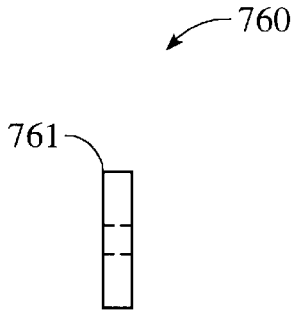
FIG. 12 is a side view of the cover bar shown in FIG. 11.

A second, generally rectangular depression 706 is formed in the surface 701 of the pulley 714. The second depression 706 extends perpendicular to the first depression 704, and the two depressions 704 and 706 are centered relative to one another and the pulley 714. The second depression 706 is shallower than the first depression 704, and the bar 741 lies substantially co-planar with the bottom of the depression 706. The second depression 706 receives a cover bar 760 which is shown in FIGS. 11–12.

The cover bar 760 includes a generally rectangular bar 761 sized and configured to nest within the second depression 706 and lie flush with the surface 701. The bar 761 overlies the mounting bar 740 and is secured in place by screws extending through holes 767 in the bar 761 and holes 707 in the pulley 714. Another hole 769 is formed through the bar 761 proximate the center thereof. The central hole 769 is similar in size to the holes 749 in the mounting bar 740. A pin 799 is inserted through the central hole 769 and any aligned hole 749 to stabilize the pulley 714 at a desired position relative to its axis of rotation (as defined by the shaft 746). As a result, a user of the apparatus 90' can readily adjust the apparatus so that the levers 420 and 440 approach their uppermost position when the user approaches a fully squatted position relative to the foot support 310, regardless of the user's height. Those skilled in the art will recognize that other means exist for making this adjustment, and that this feature, as well as the other features of the second embodiment may be combined, individually or as a whole, with the features present on the first embodiment.

Use of the invention is described with reference to the first embodiment 90 discussed above. To use the present invention, a person should lie supine against the carriage 210 and place his or her feet against the foot platform 310, generally as indicated by the guides 319 though allowing for personal comfort and/or special needs. Typically, the feet should be spread apart slightly beyond shoulder width, and the toes should be directed straight ahead or slightly outward. The shoulders should be aligned with the axis of rotation for the arms 420 and 440, and the back should rest firmly against the carriage 210. Except in the case of abdominal exercises, the head should remain in contact with the carriage 210, as well. When performing squats, a person should bend his or her knees until the upper legs approach right angles to the lower legs, and he or she should avoid locking of the knees when returning to an upright position. Force directed against the arms 420 and 440 should be transmitted through the upper arms and not the hands.

Those skilled in the art will recognize that the resent invention facilitates numerous different exercises, he combination of which includes elements of strength raining, stretching, and aerobic exercise. These different exercises include: (1) squats with one or two legs, and feet square; (2) squats with one or two legs, and feet pivoting back and forth; (3) squats with one or two legs and feet in a closed stance; (4) calf raises with one or two legs; (5) combined squats and pullovers, with one or two legs and one or two arms; (6) abdominal crunches, with carriage secured to rails; (7) abdominal crunches, with force exerted through arms to maintain carriage above lowermost position; and (8) leg lifts, with force exerted through arms to maintain carriage above lowermost position. Many of the foregoing exercises may be varied by (a) using the arms in reciprocating fashion; (b) adding the elastic cord biasing means; (c) varying the resistance, frequency, and/or range of motion for a particular movement to switch between strength training, stretching, and aerobic exercise.

Although the present invention has been described with reference to a particular application and specific embodiments, the foregoing disclosure will enable those skilled in the art to realize additional applications and embodiments. Thus, the scope of the present invention is to be limited only to the extent of the following claims.

That which is claimed is:

1. An exercise apparatus, comprising:

a frame designed to rest upon a floor surface;

a body support movably mounted on said frame and oriented with an upper plane of the body support at an acute angle of at least twenty degrees relative to the floor surface, an angle adjusting means connected to said frame for adjusting said angle at which said body support is oriented relative to said frame, wherein said body support is designed to carry a person's weight;

a pair of arms movably mounted on said body support and connected to said frame in such a manner that movement of at least one arm relative to said body support causes movement of said body support relative to said frame; and further comprising a pulley rotatable mounted to said body support, and a flexible member interconnected between said pulley and said frame, wherein said at least one arm is mounted on said pulley and rotates together therewith relative to said body support.

2. The exercise apparatus according to claim 1, wherein each arm is rotatably mounted to said body support.

3. The exercise apparatus according to claim 1, wherein said body support is rollably mounted to said frame.

4. The exercise apparatus according to claim 1, further comprising a foot platform mounted to said frame proximate the floor surface and generally positioned below said body support to support a user's feet.

5. The exercise apparatus according to claim 1, further comprising a linking member having a first end connected to said at least one arm and a second end connected to said frame proximate an upper end of said frame.

6. The exercise apparatus according to claim 5, wherein said linking member is a flexible member of fixed length, and movement of said at least one arm in a first direction relative to said body support causes said body support to travel toward said upper end of said frame, and movement of said at least one arm in a second, opposite direction relative to said body support allows said body support to travel away from said upper end of said frame.

7. The exercise apparatus according to claim 1, further comprising a pulley rotatable mounted to said body support, and a flexible member interconnected between said pulley and said frame wherein said at least one arm is mounted on said pulley and rotates together therewith relative to said body support, and further comprising an adjusting means for adjusting distance travelled by said body support in response to rotation of said pulley.

8. The exercise apparatus according to claim 7, further comprising a lip extending outward from said body support and adjustably mounted at one of several available locations along said body support proximate a lower end thereof.

9. An exercise apparatus, comprising:

a frame designed to rest upon a floor surface;

a body support designed to support a person's body weight a first connecting means, for connecting said body support to said frame in such a manner that an upper plane of said body support moves in a direction oriented at an acute angle of at least twenty degrees relative to the floor surface;

at least one lever;

a second connecting means, for connecting said at least one lever to said body support;

a third connecting means, for connecting said at least one lever to said frame in such a manner that movement of said at least one lever relative to said body support is linked to movement of said body support relative to said frame; and a biasing means interconnected between said body support and said frame, for biasing said body support in a particular direction relative to said frame, said biasing means includes at least one elastic member having a first end connected to said body support and a second end connected to said frame, and said second end of said elastic member is connected to said frame at one of a plurality of available locations, and at least one of said locations is proximate a lower end of said frame, and at least one of said locations is proximate an upper end of said frame, wherein;

said second connecting means includes a pulley rotatably mounted to said body support and to which said at least one lever is secured, and said third connecting means includes a flexible member interconnected between said frame and a radially displaced location on said pulley.

10. The exercise apparatus according to claim 9, wherein said body support has a substantially planar surface which contacts the user and which generally defines a first plane, and said pulley rotates in a second plane which is perpendicular to said first plane.

11. An exercise apparatus, comprising:

a frame designed to rest upon a floor surface;

a body support designed to support a person's body weight;

a first connecting means, for connecting said body support to said frame in such a manner that an upper plane of said body support moves in a direction oriented at an acute angle of at least twenty degrees relative to the floor surface;

at least one lever;

a second connecting means, for connecting said at least one lever to said body support;

a third connecting means, for connecting said at least one lever to said frame in such a manner that movement of said at least one lever relative to said body support is linked to movement of said body support relative to said frame; and a biasing means interconnected between said body support and said frame, for biasing said body support in a particular direction relative to said frame, said biasing means includes at least one elastic member having a first end connected to said body support and a second end connected to said frame, and said second end of said elastic member is connected to said frame at one of a plurality of available locations, and at least one of said locations is proximate a lower end of said frame, and at least one of said locations is proximate an upper end of said frame, wherein;

said at least one lever includes:

an upper arm accommodating portion having a first end rotatably connected to said body support, and having a second, remote end, a lower arm accommodating portion having a first end connected to said second, remote end of said upper arm accommodating portion, and having a second, remote end, wherein said lower arm accommodating portion extends perpendicular to said upper arm accommodating portion and cooperates therewith to define a first plane;

an axial portion having a first end connected to said second, remote end of said lower arm accommodating portion, and having a second, remote end, wherein said axial portion extends perpendicular to said first plane and generally toward said body support, and said axial portion and said lower arm accommodating portion cooperate to define a second plane; and a handgrip portion having a first end connected to said second, remote end of said axial portion, and having a second, distal end, wherein said handgrip portion and said upper arm accommodating portion extend generally parallel to one another and are extended in a similar direction away from said second plane.

12. An exercise apparatus, comprising:

a frame having a first portion designed to rest upon a floor surface and a second portion having an upper planar surface extending at an acute angle of at least twenty degrees relative to said first portion, wherein said second portion of the frame extends upwards from the first portion in a vertical direction away from the first portion and the floor surface;

a carriage designed to support a person's back and carry a person's weight, rollably mounted to said second portion of said frame, and comprising a stop selectively interconnected between said carriage and said second portion of said frame to prevent travel of said carriage relative thereto;

first and second pulleys rotatably mounted on opposite sides of said carriage and having a common axis of rotation that extends perpendicular to said vertical plane;

first and second arms mounted on said first and second pulleys, respectively; and first and second cord segments interconnected between said frame and said first and second pulleys, respectively.

13. The exercise apparatus according to claim 12, wherein rotation of said pulleys in a first direction causes respective cord segments to wind about circumferential surfaces on respective pulleys, thereby pulling said carriage upward along said second portion of said frame, and rotation of said pulleys in a second, opposite direction causes said respective cord segments to unwind from said circumferential surfaces on said respective pulleys, thereby allowing said carriage to return downward along said second portion of said frame.

14. The exercise apparatus according to claim 12, wherein said arms extend generally upward when said carriage occupies a lowermost position along said second portion of said frame, and said arms are rotated generally forward and downward to move said carriage to an uppermost position along said second portion of said frame.

15. The exercise apparatus according to claim 12, wherein each of said arms includes a first portion disposed inward of and extending radially from a respective pulley, said first portion being designed to parallel and support a person's upper arm, and a second portion extending from a remote end of said first portion and perpendicular thereto, said second portion being designed to parallel and support a person's forearm.

16. The exercise apparatus according to claim 12, further comprising a resilient tension bearing member interconnected between said carriage and said frame to bias said carriage in a particular direction along said second portion of said frame.

17. An exercise apparatus according to claim 12, wherein said frame further includes a third portion interconnected between said first portion and said second portion and cooperating therewith to form an acute triangle, and wherein said third portion has a length defined between said first portion and said second portion, and said length is selectively adjustable.

18. An exercise apparatus, comprising:

a frame having a first end portion designed to rest upon a floor surface and a second portion having an upper planar surface extending at an acute angle of at least twenty degrees relative to said first portion, wherein said second portion of the frame extends upwards from the first portion in a vertical direction away from the first portion and the floor surface;

a carriage designed to support a person's back and carry a person's weight, and rollably mounted to said second portion of said frame;

first and second pulleys rotatably mounted on opposite sides of said carriage and having a common axis of rotation that extends perpendicular to said vertical plane;

first and second arms mounted on said first and second pulleys, respectively;

first and second cord segments interconnected between said frame and said first and second pulleys, respectively; and an angle adjusting means connected to said frame, for adjusting said angle at which said second portion of said frame extends relative to said first portion.

19. An exercise apparatus, comprising:

a frame having a first end portion designed to rest upon a floor surface and a second portion extending at an acute angle of at least twenty degrees relative to said first portion, wherein said second portion of the frame extends upwards from the first portion in a vertical direction away from the first portion and the floor surface;

a carriage designed to support a person's back and carry a person's weight, and rollably mounted to said second portion of said frame;

first and second pulleys rotatably mounted on opposite sides of said carriage and having a common axis of rotation that extends perpendicular to said vertical plane;

first and second arms mounted on said first and second pulleys, respectively;

first and second cord segments interconnected between said frame and said first and second pulleys, respectively; and said frame further includes a third portion interconnected between said first portion and said second portion and cooperating therewith to form an acute triangle.

20. An exercise apparatus according to claim 19, wherein said third portion has a length defined between said first portion and said second portion.

21. An exercise apparatus, comprising:

a frame having a first end portion designed to rest upon a floor surface and a second portion extending at an acute angle of at least twenty degrees relative to said first portion, wherein said second portion of the frame extends upwards from the first portion in a vertical direction away from the first portion and the floor surface;

a carriage designed to support a person's back and carry a person's weight, and rollably mounted to said second portion of said frame;

first and second pulleys rotatably mounted on opposite sides of said carriage and having a common axis of rotation that extends perpendicular to said vertical plane;

first and second arms mounted on said first and second pulleys, respectively;

first and second cord segments interconnected between said frame and said first and second pulleys, respectively; and a foot support rotatably connected to said frame proximate a lower end thereof and extending generally perpendicular to said second portion.

* * * * *